US008899305B2

(12) United States Patent
Ansoldi et al.

(10) Patent No.: US 8,899,305 B2
(45) Date of Patent: Dec. 2, 2014

(54) CRYSTALLIZER FOR CONTINUOUS CASTING

(75) Inventors: Marco Ansoldi, Udine (IT); Gianluca Bazzaro, Codroipo (IT); Andrea De Luca, Remanzacco (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 13/989,996

(22) PCT Filed: Nov. 24, 2011

(86) PCT No.: PCT/IB2011/002797
§ 371 (c)(1),
(2), (4) Date: Aug. 1, 2013

(87) PCT Pub. No.: WO2012/069913
PCT Pub. Date: May 31, 2012

(65) Prior Publication Data

US 2013/0319629 A1 Dec. 5, 2013

(30) Foreign Application Priority Data

Nov. 25, 2010 (IT) ..... UD2010A0215

(51) Int. Cl.
*B22D 11/124* (2006.01)
*B22D 11/041* (2006.01)
*B22D 11/055* (2006.01)

(52) U.S. Cl.
CPC ..... *B22D 11/055* (2013.01); *B22D 11/041* (2013.01)
USPC ..... 164/443; 164/485

(58) Field of Classification Search
CPC .... B22D 11/124; B22D 11/055; B22D 11/04; B22D 15/00; B22D 15/02; B22D 15/04
USPC ..... 164/443, 485
See application file for complete search history.

(56) References Cited

U.S. PATENT DOCUMENTS

2004/0256080 A1 12/2004 Rahmfeld et al.
2005/0115695 A1 6/2005 Mangler et al.

FOREIGN PATENT DOCUMENTS

DE 4127333 2/1993
DE 102008032672 1/2010
EP 1356879 10/2003

*Primary Examiner* — Kevin P Kerns
*Assistant Examiner* — Steven Ha
(74) *Attorney, Agent, or Firm* — Hamre, Schumann, Mueller & Larson, P.C.

(57) ABSTRACT

Crystallizer for continuous casting, having a monolithic structure defined by lateral walls in the thickness of which channels (11) are made in which a cooling liquid flows. The channels (11) are geometrically sized so as to define, in a zone substantially astride the meniscus (M), an increased transit speed of the cooling liquid, wherein by increased speed it is intended that in at least some of the cooling channels (11) the speed of transit of the cooling liquid is greater in the zone astride the meniscus (M) compared with a zone below or above said zone astride the meniscus (M).

11 Claims, 5 Drawing Sheets

CRYSTALLIZER FOR CONTINUOUS CASTING

FIELD OF THE INVENTION

The present invention concerns a crystallizer for continuous casting with a long working life.

The invention is used in the iron and steel field of technology to cast billets or blooms of any type and section, preferably square or rectangular but also polygonal in general, or round.

BACKGROUND OF THE INVENTION

In continuous casting, reaching a high casting speed and therefore attaining an always higher productivity, while still maintaining both the surface and internal quality of the cast product high, is connected to the optimization of a plurality of technological parameters relating both to the characteristics of the crystallizer and to the equipment connected to it, and also to the casting method.

Said parameters principally concern the geometric and dimensional characteristics of the crystallizer, the primary cooling system, the lubrication system of the internal walls and the material the crystallizer is made of.

Such parameters affect the capacity of the crystallizer to support the high thermal and mechanical stresses and the wear to which it is subjected, thus determining its operating life in conditions of great efficiency.

As far as the primary cooling system is concerned, in the known type of crystallizers, the high temperatures reached by the internal walls, in particular in the zone around the meniscus, significantly condition the tensional and deformational state of the crystallizer, considerably limiting the casting speeds that can be obtained because of the plastic deformation of the crystallizer and of the consequent drastic reduction in its working life.

Moreover, the variation in the thermal flow in the casting direction, which has a peak in correspondence to the zone of the meniscus, makes the temperature not uniform along the crystallizer, thus causing a non-homogenous deformation state, with subsequent problems connected to the defects in shape which this deformation causes on the cast product and to the premature wear of the crystallizer, which reduces its useful life.

A further problem is connected to maintaining the crystallizer in conditions of efficiency for long periods before having to resort to maintenance and/or replacement, deriving in particular from localized cracks in the zone of the meniscus caused by tensions and plastic deformation accumulated during the heating cycles.

In the crystallizers currently used it has been impossible to find a satisfying solution to all these problems, and indeed the attempt to solve them has instead led to accentuate others.

Thus, for example, in the attempt to increase the casting speed an unsatisfactory cooling of the product being made was obtained, and therefore the solidification of an insufficient thickness of the skin, with subsequent problems of breakage of the skin outside the crystallizer.

On the other hand, when it was tried to obtain an optimal cooling of the product, this entailed a reduction in the casting speed and therefore a reduction in productivity.

The document DE 4127333 describes a tubular crystallizer in which some channels, made in the walls and in which the cooling fluid circulates, are divided into parts in the zone astride the meniscus, by inserting little tubes of various sizes which divide the passage section.

The document US 2004256080 describes channels for the cooling liquid which have a smaller cross section in the upper zone and larger in the lower zone.

However, these documents do not describe any quantitative or qualitative criterion to identify the proportion between the channels with a larger section and channels with a smaller section, and/or their disposition, in the zone astride the meniscus.

The present invention thus proposes to supply an answer to these problems, looking for a solution which allows, in the first place, to increase the working life of the crystallizer in conditions of high casting efficiency, also bearing in mind the need to maintain as unchanged as possible the internal shape, with its substantially conical profile.

One purpose of the present invention is therefore to give the crystallizer a primary cooling system which allows to reach high casting speeds and at the same time allows to obtain a high number of casting cycles, so as to increase the working life of the crystallizer in conditions of great efficiency.

A further purpose of the invention is to reduce the peak value of the heat flow in correspondence to the zone of the meniscus so as to render as uniform as possible the development of the temperature along the crystallizer, allowing to maintain its shape unaltered, thus giving benefits in the quality of the final product and its casting ability, and to reduce the tensional and deformation condition with the advantage of a longer working life of the component.

The Applicant has devised, tested and embodied the present invention to overcome the shortcomings of the state of the art and to obtain these and other advantages, in particular a considerable increase in the working life of the crystallizer.

SUMMARY OF THE INVENTION

The present invention is set forth and characterized in the independent claim, while the dependent claims describe other characteristics of the invention or variants to the main inventive idea.

The principles of the invention are based on the consideration that the zone of the crystallizer most subject to thermal-mechanical stresses is the one that is astride the meniscus, therefore comprising a strip which, in operating conditions, contains the meniscus.

The entity of heat transfer between the cooling liquid, which flows in longitudinal channels made in the thickness of the walls of the crystallizer, and the liquid steel cast inside the crystallizer, mainly depend on the number and position of the cooling channels with respect to the internal edge of the walls, and on the geometry of the holes, which influences the speed of the cooling liquid and therefore the coefficient of heat exchange, that is, the capacity of removing the heat from the liquid steel.

Since the number of cycles until breakage, that is, the working life of the crystallizer, is inversely proportional to the plastic deformation accumulated in each cycle, it is extremely important to control the thermal field in the crystallizer in order to guarantee a prolonged working life in efficient conditions.

The crystallizer to which the invention is applied is characterized above all in having a monolithic tubular structure, with a square, rectangular or polygonal in general section, or even round, in which the sides which define the section can normally vary from 90 mm to 500 mm, preferably from 120 mm to 200 mm, while the longitudinal development has a length generally comprised between 780 and 1600 mm.

The crystallizer to which the invention is applied has longitudinal channels for the passage of cooling liquid made directly in the thickness of its walls, and generally distributed in a substantially uniform manner on the walls.

Moreover, the crystallizer to which the present invention is applied has a conical internal profile which adjusts as the material cast progressively shrinks, from the entrance to the exit in relation to its progressive solidification.

In the context of the invention, an essential requisite is that the conical internal shape remains the same as the casting cycles continue, so as to always guarantee the dimensional quality and the shape of the cast product and an optimal contact of the product with the wall of the crystallizer during the solidifying step.

According to one feature of the present invention, some of the channels in which the cooling liquid flows are geometrically sized so as to define, in a zone substantially astride the meniscus, and in any case comprising the meniscus, an increased transit speed of the cooling liquid: the channels with greater transit speed are alternated in the zone astride the meniscus with channels with lower transit speed. By increased speed we mean that in some of the cooling channels the speed of transit of the cooling liquid is greater in the zone astride the meniscus compared with a zone below the zone astride the meniscus.

According to a first form of embodiment of the invention, the cooling channels are divided into at least two groups, in which a first group of channels has a first diameter, or equivalent diameter, and develops through for the whole longitudinal extension of the crystallizer, and a second group of channels, disposed alternate to the channels of the first group, has a second diameter, or equivalent diameter, smaller than the first diameter of the first group, and develops for a smaller extension than the length of the crystallizer, and in particular develops from a position near the top of the crystallizer to a position below the zone where, during use, the meniscus of the liquid metal is located.

In a first solution the smaller diameter can be made to specification in the construction of the crystallizer while, according to a variant, the cooling channels are made to specification all with the same diameter and at least some of these are divided, at least for the longitudinal segment astride the meniscus, with suitable dividing means which reduce the transit section.

In another form of embodiment, a first part, or first group of the cooling channels has a segment astride the meniscus of a reduced diameter, which is connected to at least a respective segment with a greater diameter which extends from the zone astride the meniscus up to the lower end of the crystallizer; this part of the channels thus configured is alternated with a second part, or second group, of channels for the cooling liquid which, on the other hand, have constant diameters and greater than said reduced diameter.

In a specific form of embodiment, the cooling channels of the first group develop longitudinally passing through the whole extension of the crystallizer, with a first smaller diameter in a zone astride the meniscus, and a second diameter larger than the first diameter in the part below, or possibly above, the zone astride the meniscus.

The presence of some of the cooling channels, or segments of the channels, of reduced diameter, the longitudinal extension of which is limited to the zone astride the meniscus, allows to reduce the passage section of the cooling liquid and therefore to increase locally the transit speed of the cooling liquid, consequently intensifying, and in a localized manner, the coefficient of heat exchange and therefore the capacity of removing the heat.

With the present invention therefore, astride the zone of the meniscus where the temperatures reached and the risk of localized cracks forming due to the mechanical heat stresses are greater, we have an increased cooling capacity thanks to the greater speed of the cooling fluid due to the reduction in section of the channels where the fluid passes.

Moreover, since as the passage section diminishes there is also an increase in the load losses of the liquid, the increase in speed is generated only locally, that is, around the zone of the meniscus, and not for all the length of the crystallizer, thus fulfilling its function only where there is greater need to remove heat in order to reduce the peak value of the thermal flow.

In this way we obtain an optimal compromise between the increase in the capacity to remove heat in a localized and specific zone and the losses of load so that, all the parameters of the cooling system (water flow rate, overall dimension of the cooling channels, number of holes and positions etc.) being equal, the strategy of increasing the speed of the cooling fluid only in the localized zone astride the meniscus determines a reduction in the thermal stresses and consequently a lesser plastic deformation of the crystallizer as the casting cycles continue, with a subsequent increase in the working life of the crystallizer in efficient conditions.

In forms of embodiment of the present invention, the larger equivalent diameter of the channels is comprised between 8 and 16 mm, while the smaller equivalent diameter of the channels is comprised between 4 and 10 mm.

In a first solution, the channels with the smaller section and length can discharge the cooling liquid laterally in correspondence to the interruption point.

In a variant, the channels with the smaller section and length can be joined, or connected by means of a collector, to the channels with greater section and length, so that the cooling liquid flows from the former to the latter and exits in correspondence to the lower end of the crystallizer.

In a further variant, as stated, the cooling channels change their diameter, increasing it, below the zone astride the meniscus where there is a reduced diameter.

BRIEF DESCRIPTION OF THE DRAWINGS

These and other characteristics of the present invention will become apparent from the following description of some preferential forms of embodiment, given as a non-restrictive example with reference to the attached drawings wherein.

DETAILED DESCRIPTION OF THE PREFERENTIAL FORMS OF EMBODIMENT

Figure 3:
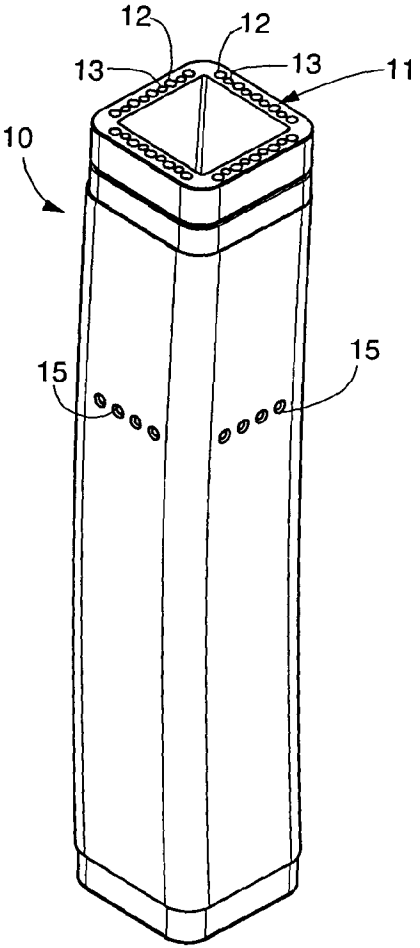
FIG. 3 shows a three-dimensional view of the crystallizer in FIG. 1.

With reference to the attached drawings, the number 10 indicates in its entirety a crystallizer according to the invention. The crystallizer 10 has a monolithic tubular structure in section, in this case square, with holes/channels, generically indicated with the reference number 11, for the passage of a cooling liquid, made in the thickness of its walls.

A typical section of the crystallizer 10 is for example square, but this type of section is only an example and in no way limiting in the context of the present invention.

In the first form of embodiment in FIGS. 1-7, the holes/channels for the cooling liquid 11 are subdivided into two groups, in which the first is formed by holes/channels 12 having a first size (hereafter defined equivalent diameter when their shape is not exactly circular), while the second is formed by holes/channels 13 having equivalent diameter smaller than the first.

With the term diameter, or equivalent diameter, as it is clear from the drawings, particularly FIGS. 4-7 and 11-13, it is intended the diameter of the holes/channels 12 or 13 measured on a transversal section of the crystallizer 10.

In this case the holes/channels 12 of the first group having the larger equivalent diameter are alternated with the holes/channels 13 of the second group having the smaller equivalent diameter.

In the first form of embodiment, both the holes/channels 12 with the larger equivalent diameter and the holes/channels 13 with the smaller equivalent diameter originate substantially in correspondence to the entrance section of the crystallizer and are disposed alternated along the walls of the crystallizer 10.

Figure 2:
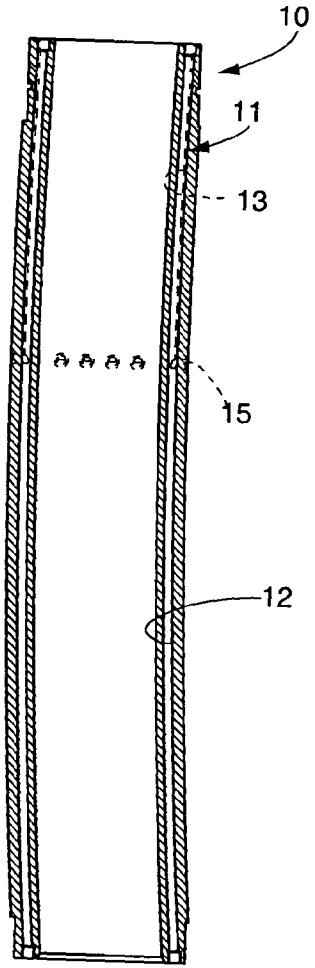
FIG. 2 shows a longitudinal section from A to A of the crystallizer in FIG. 1.
Figure 1:
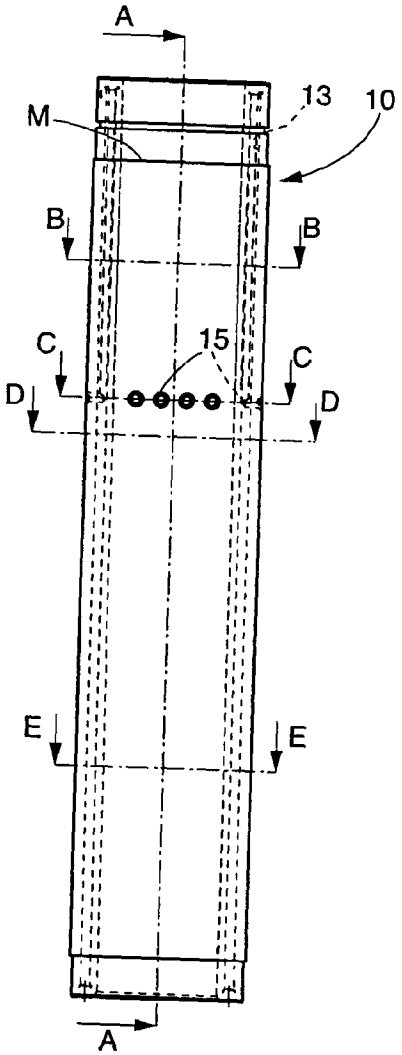
FIG. 1 shows a view, partly transparent, of a first possible form of embodiment of a crystallizer according to the present invention.
Figure 5:
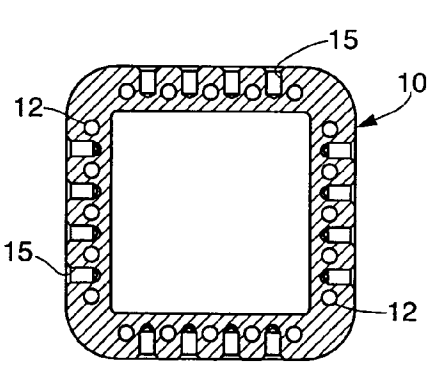
FIGS. 4-7 show the cross sections respectively from B to B, C to C, D to D, E to E.
Figure 7:
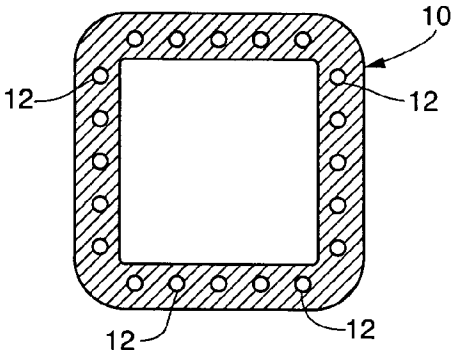

With reference to FIGS. 1, 2 and 5, it is possible to see how the holes/channels 13 with the smaller equivalent section are interrupted and terminate at the lower part with a lateral outlet 15, by means of which the cooling liquid is sent outside the crystallizer 10 to be reintroduced into the cooling circuit.

As said, the holes/channels 12 are through on the length of the crystallizer 10, while the holes/channels 13 have a height comprised between 300 and 400 mm with respect to the top of the crystallizer 10, therefore covering a longitudinal segment astride the meniscus zone, which is generally placed at about 120 mm from the top.

The alternate disposition of the holes/channels 12 with larger diameter and the holes/channels 13 with smaller diameter causes a division in the flow rate of the cooling liquid which circulates in the crystallizer due to the fall in pressure which occurs in the holes.

In the holes/channels 12 with a larger diameter, from 50% to 70% of the flow rate can circulate, preferably from 55% to 60% of the liquid used to cool the crystallizer, while in the holes/channels 13 with a smaller diameter from 30% to 50% of the flow rate can circulate, preferably from 40% to 45%.

In the holes/channels 13 with a smaller diameter the cooling liquid transits at a higher speed compared to its transit speed in the holes/channels 12 with a larger diameter, thus increasing the coefficient of heat exchange.

The percentage increase in speed in the holes/channels 13 with a larger diameter compared to the holes/channels 12 with a smaller diameter is equal to the percentage division in the flow rate of the cooling liquid in the respective holes/channels.

Compared to a conventional crystallizer therefore, the crystallizer 10 according to the present invention, given the same overall flow rate of the cooling liquid, allows to obtain an overall increase in thermal power removed in the zone of the meniscus from 20 to 40% more, to which a reduction of the peak temperature corresponds.

Figure 4:
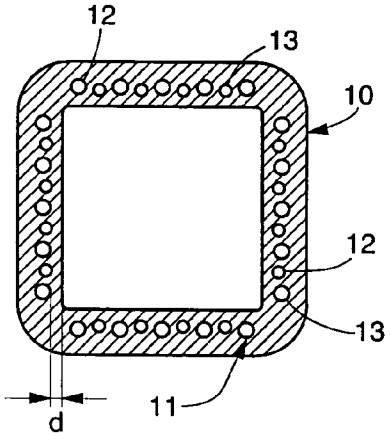
Figure 6:
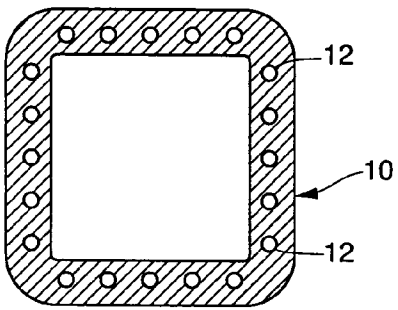
Figure 10:
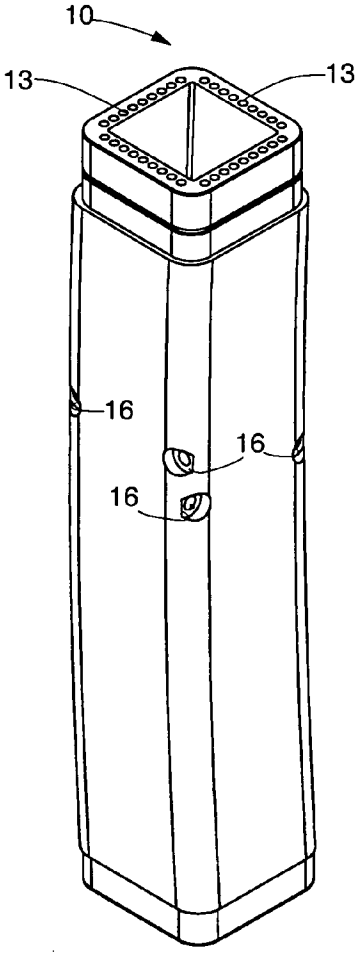
FIG. 10 shows a three-dimensional view of the crystallizer in FIG. 8.

FIG. 4 shows holes/channels with an exactly circular section: the small holes 13 and the big holes 12 of each side of the crystallizer 10 are disposed substantially tangent to a hypothetical line which has a distance "d" for about 5-9 mm from the respective internal face of the crystallizer. To obtain this, the small holes 13 are made with their centers displaced toward the internal face of the crystallizer 10 with respect to the centers of the big holes 12.

In accordance with an advantageous variant, not shown, the small holes 12 are placed even nearer to the internal face of the crystallizer 10 with respect to the tangent to the big holes 12, about 1-4 mm for example. This increases the capacity to remove the heat by the portion of cooling liquid which circulates in the small holes 13, with a greater speed compared to the speed of the liquid in the big holes 12.

Instead of being made to specifications with a smaller section, the holes/channels 13 can be divided by suitable reduction means to reduce the passage section, inserted along the whole of their length, in order to thus reduce the section through which the cooling liquid transits, and consequently to increase the speed and therefore the heat exchange.

The means to reduce the passage section can have any shape, for example circular, half moon shaped, star shaped, annular or any shape as desired.

In accordance with the second form of embodiment shown in FIGS. 8-15, the holes/channels 13 with a smaller diameter, alternated in the zone astride the meniscus M with holes/channels with a larger diameter 12, are not interrupted at the lower part but transform into holes/channels 12 with a larger equivalent diameter.

In other words, the holes/channels have a first smaller equivalent diameter in an upper zone of the crystallizer 10 astride the meniscus, for a length of about 350 mm for example, and a second larger equivalent diameter starting from said zone until as far as the lower end of the crystallizer 10. In the drawings, the same holes are therefore identified by the number 13 in the upper part and by the number 12 in the lower part of the crystallizer 10.

Figure 9:
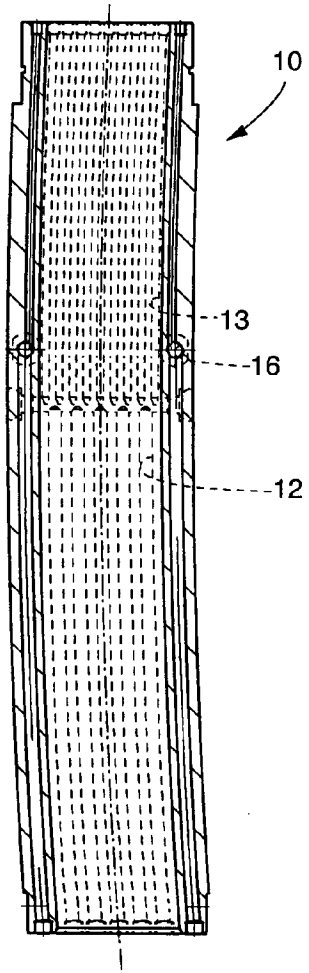
FIG. 9 shows the longitudinal section from K to K of the crystallizer in FIG. 8.
Figure 8:
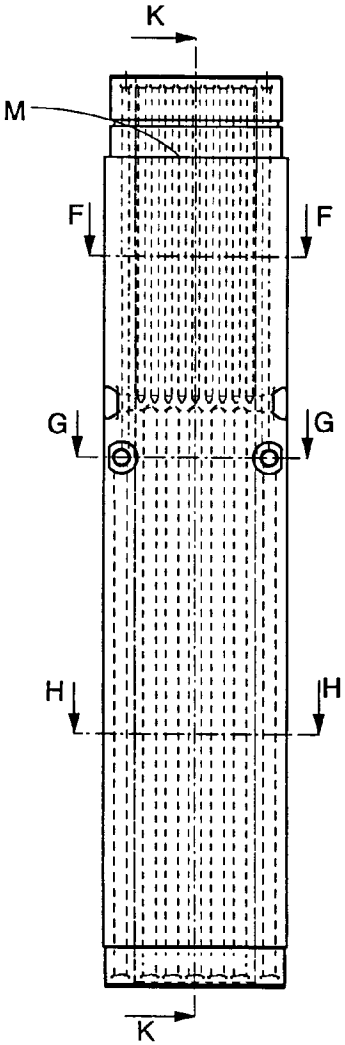
FIG. 8 shows a view, partly transparent, of a second possible from of embodiment of the crystallizer according to the invention.
Figure 11:
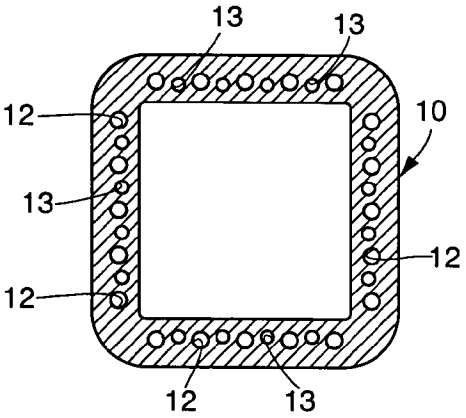
FIGS. 11-13 show the transverse sections respectively from F to F, G to G and H to H.
Figure 13:
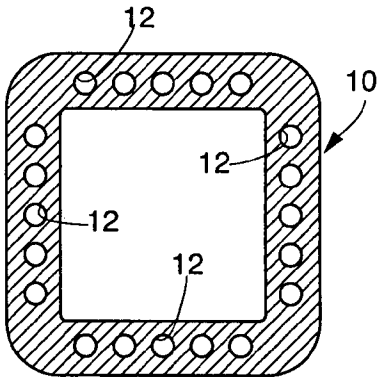
Figure 12:
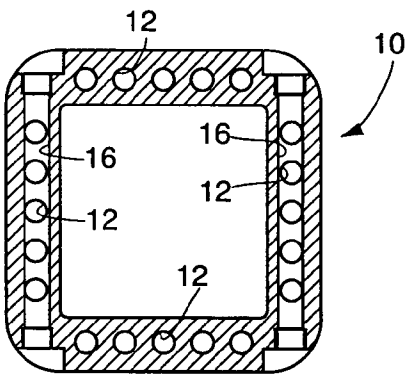
Figure 14:
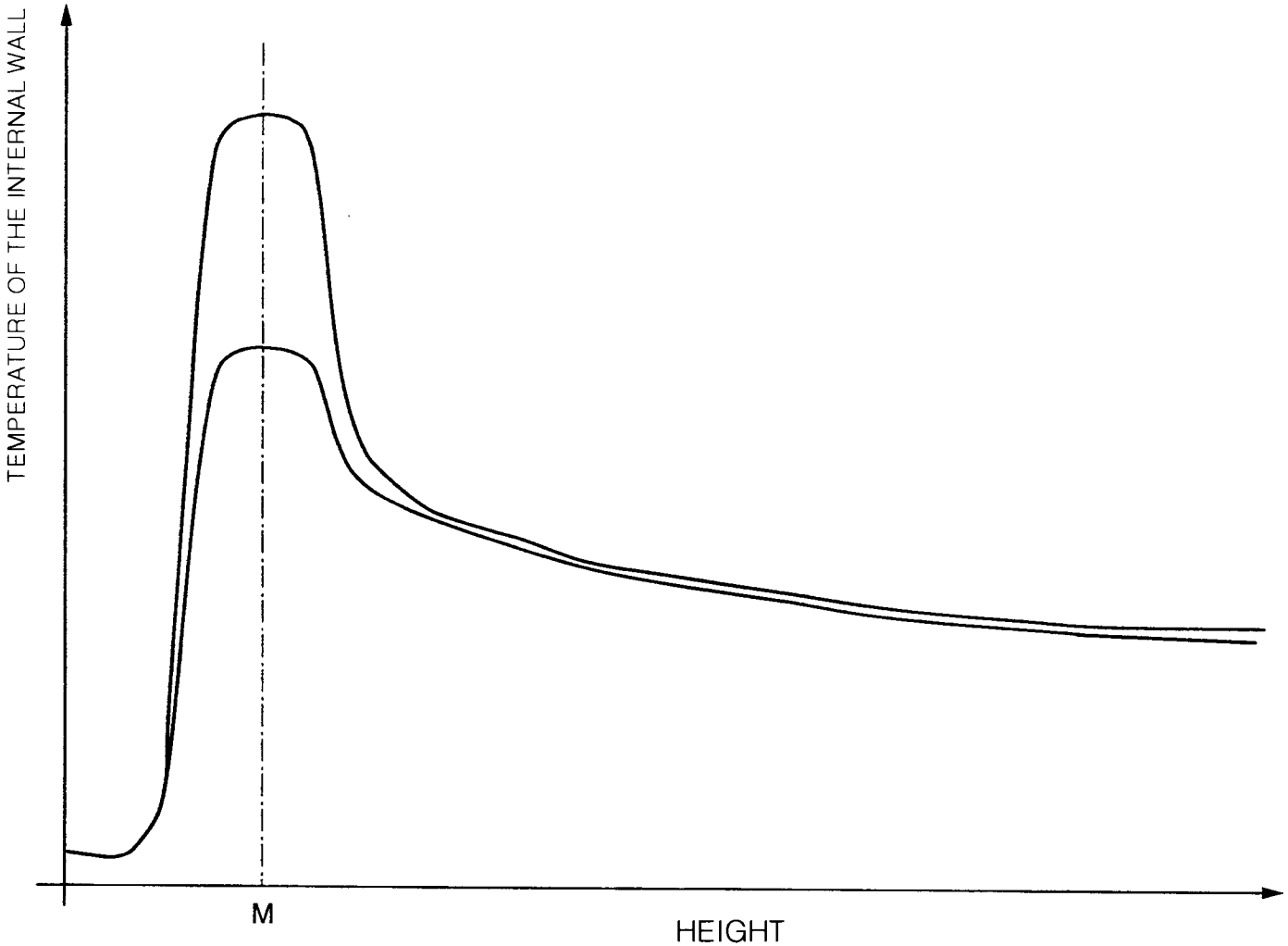
FIG. 14 shows a qualitative graph of the development of the temperature along the height of the meniscus using a traditional cooling and a cooling according to the present invention.

With reference to FIGS. 8 and 9, the holes/channels 13 with a smaller equivalent diameter end at the lower part in a collector 16 by means of which the cooling liquid is sent inside the holes/channels 12 with a larger equivalent diameter.

In the second form of embodiment too, the holes with a smaller equivalent diameter 13 extend for a length of about 300-400 mm with respect to the top of the crystallizer 10.

In any case, the longitudinal development of the holes/channels 13 with a smaller equivalent diameter extends along a zone which is astride the zone in which, during casting, the meniscus of the metal liquid is positioned, indicated by the letter M in FIGS. 1 and 8.

Since the reduced equivalent diameter of the holes/channels 13 causes an increase in speed of the cooling liquid and, as a consequence a greater capacity of heat removal, with the solutions of the present invention the zone astride the meniscus M is cooled more intensely than the lower part of the crystallizer 10, which is subjected to lower thermal stresses.

In this way, the overall capacity of removing heat generated by the combination of the cooling holes/channels is intensified in the zone astride the meniscus M, where there is a need to contrast the peak of the thermal flow which determines a tensional state which tends to plasticize the material of the crystallizer 10.

As far as the solution in FIGS. 8-15 is concerned, in the lower zone, the holes/channels 13 with a smaller equivalent diameter are interrupted or the holes/channels 12 with a larger equivalent diameter are transformed, in that the needs for cooling are smaller, and at the same time the losses of load deriving from the localized reduction in the passage section of the cooling liquid are reduced to the smallest possible.

With the present invention we therefore obtain that, given the same overall parameters of the cooling system, that is, flow rate and pressure of the liquid, overall dimension of the holes, position and number of the latter, we obtain a greater capacity of removing the heat localized in the upper zone of the crystallizer 10, where it is most needed, and a lesser capacity of removing the heat in the zone where it is less needed.

FIG. 16 shows a qualitative graph which shows how, compared to a traditional solution (line of dashes), the development of the temperature along the crystallizer indicates a considerable reduction of the peak in correspondence to the meniscus M, adopting one of the solutions according to the present invention.

These alternative solutions can clearly be applied in any geometry of holes and relative positions along the walls of the crystallizer 10.

It is obvious that modifications and/or additions may be made to the present invention, without departing from the field and scope thereof.

The invention claimed is:

1. A crystallizer for continuous casting, comprising:

a monolithic structure defined by lateral walls in the thickness of which channels are made in which a cooling liquid flows, wherein the channels are geometrically sized so as to, in a zone astride a meniscus, increase a transit speed of a cooling liquid, wherein in at least some of the cooling channels the transit speed of the cooling liquid is greater in the zone astride the meniscus compared to a zone below the zone astride the meniscus, wherein the channels include:

in the zone astride the meniscus, a plurality of first channels having a larger diameter, and a plurality of second channels having a smaller diameter, wherein the smaller diameter defining a reduced passage section of the cooling liquid with respect to a passage section defined by the larger diameter, and the second channels having the smaller diameter are disposed alternatingly between the first channels having the larger diameter, and in the zone below the zone astride the meniscus, there are only the first channels having the larger diameter.

2. The crystallizer as in claim 1, wherein at least some of the channels have the smaller diameter defining the reduced passage section in the zone astride the meniscus, and then widen to have the larger diameter defining the passage section in the zone below the zone astride the meniscus or a zone above the zone astride the meniscus.

3. The crystallizer as in claim 1, wherein the smaller diameter, and therefore the reduced passage section, is defined by section reduction means inserted inside channels with the larger diameter.

4. The crystallizer as in claim 1, wherein the larger diameter of the first channels is between 8 and 16 mm, and the smaller diameter of the second channels is between 4 and 10 mm.

5. The crystallizer as in claim 1, wherein the crystallizer has a length of between 780 and 1600 mm, and the zone where the second channels with the smaller diameter terminate is around 300-400 mm from the top of the crystallizer.

6. The crystallizer as in claim 1, wherein the second channels with a smaller diameter terminate at a lower part with a lateral outlet by means of which the cooling liquid can be sent outside of the crystallizer.

7. The crystallizer as in claim 1, wherein the second channels with the smaller diameter terminate at a lower part with a collector by means of which the cooling liquid is sent inside the first channels with the larger diameter.

8. The crystallizer as in claim 1, wherein the second channels with the smaller diameter and the first channels with the larger diameter of each side of the crystallizer are disposed substantially tangent to a line located at a distance from a respective internal face of the crystallizer, centers of the second channels with the smaller diameter being displaced toward the respective internal face of the crystallizer with respect to centers of the first channels with the larger diameter.

9. The crystallizer as in claim 8, wherein said distance is from 5 to 9 mm.

10. The crystallizer as in claim 1, wherein the second channels with the smaller diameter are located nearer to an internal face of the crystallizer with respect to a tangent to the first channels with the larger diameter.

11. The crystallizer as in claim 10, wherein the second channels are located at about 1-4 mm from the internal face.

* * * * *